US005359793A

United States Patent [19]

Copperstone

[11] Patent Number: 5,359,793

[45] Date of Patent: Nov. 1, 1994

[54] GREETING CARD WITH BOOKMARK

[76] Inventor: Janice A. Copperstone, 4493 Brafferton Dr., Bloomfield Hills, Mich. 48302

[21] Appl. No.: 48,423

[22] Filed: Apr. 14, 1993

[51] Int. Cl.[5] ..... G09F 1/00

[52] U.S. Cl. ..... 40/124.1; 281/42; 283/117

[58] Field of Search ..... 40/124.1; 281/42, 45; 283/117

[56] References Cited

U.S. PATENT DOCUMENTS

| | | | |
|---|---|---|---|
| 2,111,520 | 3/1938 | White | 40/124.1 |
| 2,547,359 | 4/1951 | Bacharach . | |
| 2,616,199 | 11/1952 | Robins . | |
| 2,633,372 | 3/1953 | Wilson | 281/42 |
| 2,696,690 | 12/1954 | Bender | 40/124.1 |
| 2,911,940 | 11/1959 | Greider | 281/42 |
| 2,964,010 | 12/1960 | Harrison | 281/42 |
| 3,191,328 | 6/1965 | Lohnes . | |
| 3,235,988 | 2/1966 | Paige . | |
| 4,055,690 | 10/1977 | Patterson . | |
| 4,176,473 | 12/1979 | Rae . | |
| 4,439,941 | 4/1984 | Halperin . | |
| 4,440,298 | 4/1984 | Knight | 40/124.1 X |
| 4,838,198 | 6/1989 | Knox . | |
| 4,917,240 | 4/1990 | Roberts et al. | 40/124.1 X |
| 5,110,155 | 5/1992 | Piechocki et al. . | |
| 5,117,569 | 6/1992 | Bean | 40/124.1 |

OTHER PUBLICATIONS 1989 sale by Birmingham-Bloomfield Art Association photoreproduction of J. Copperstone's art work design mounted on bookmark.

Nov. 1990, 20 packages; 10 imprinted cards, 10 separate imprinted bookmarks 10 imprinted thank you cards sold in a single package.

Dec. 1991, Birmingham-Bloomfield Art Assn. Sale of J. Copperstone's separate bookmark mounted on cardboard next to card carrying corr. design, packaged in clear envelope.

*Primary Examiner*—Edward K. Look
*Assistant Examiner*—Hoang Nguyen
*Attorney, Agent, or Firm*—Gifford, Groh, Sprinkle, Patmore and Anderson

[57] ABSTRACT

A greeting card with removable bookmark combination comprises a sheet forming at least one leaf, an ornamented, preferably rigid sheet and a connector for removably attaching the ornamented sheet to a leaf of the card without substantially increasing the thickness of the card. Preferably, a threaded loop is wound through perforations in the leaf of the folded sheet and receives an elongated tassel tied to the ornamented rigid sheet forming the bookmark. Alternatively, the bookmark may-be retained in a relatively fixed position with respect to the sheet forming the card by slits within the sheet to form a retainer for the bookmark. The slits may be made in pairs, and multiple pairs may form straps that removably connect the bookmark ornamental indicia to the card leaf.

23 Claims, 2 Drawing Sheets

FIG 1
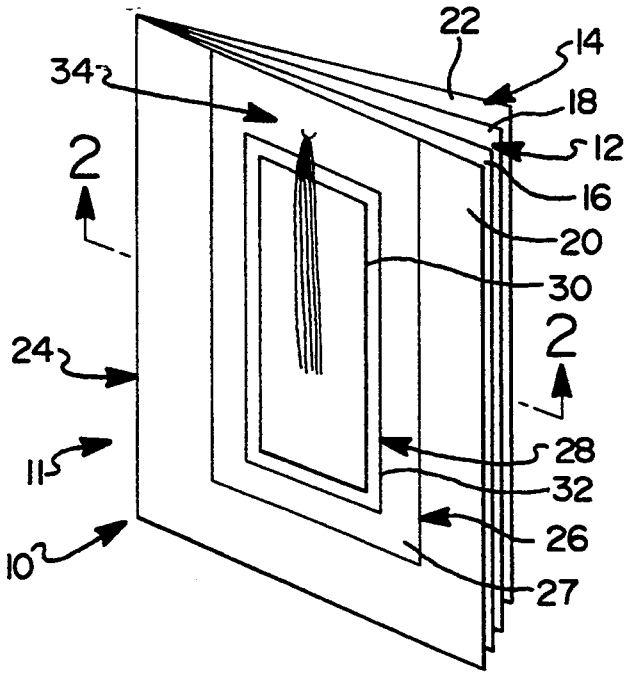
FIG 4
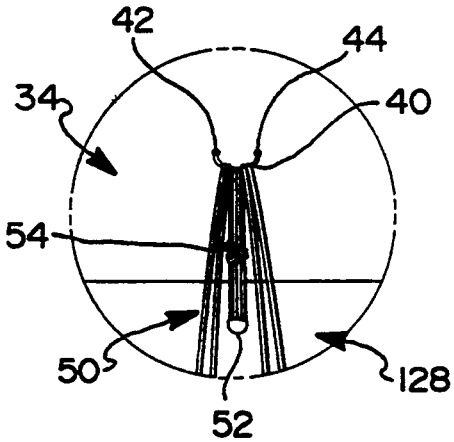
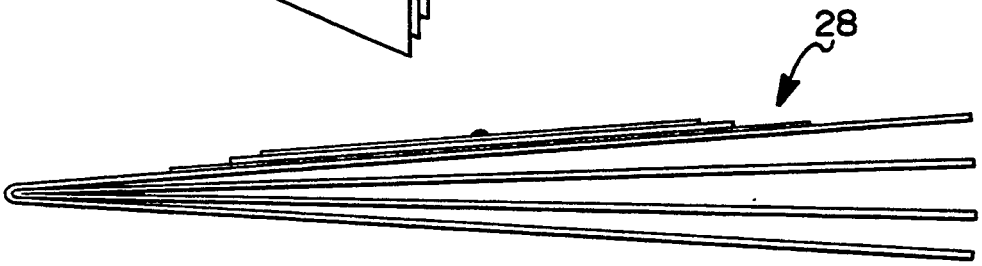
FIG 2
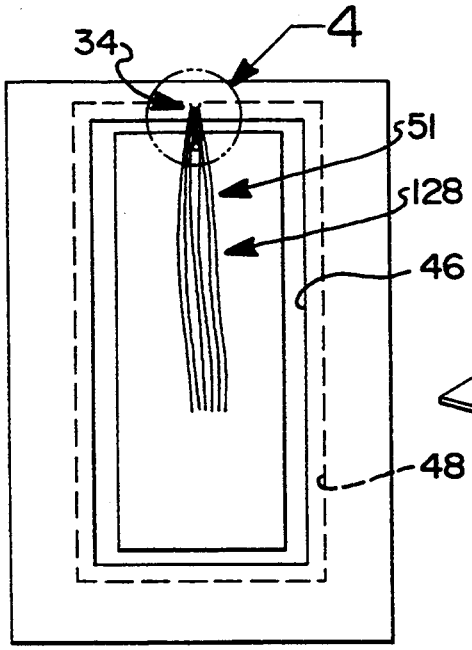
FIG 3
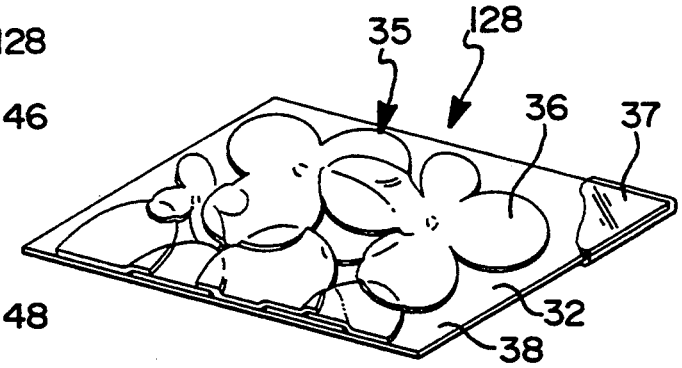
FIG 5

FIG 7
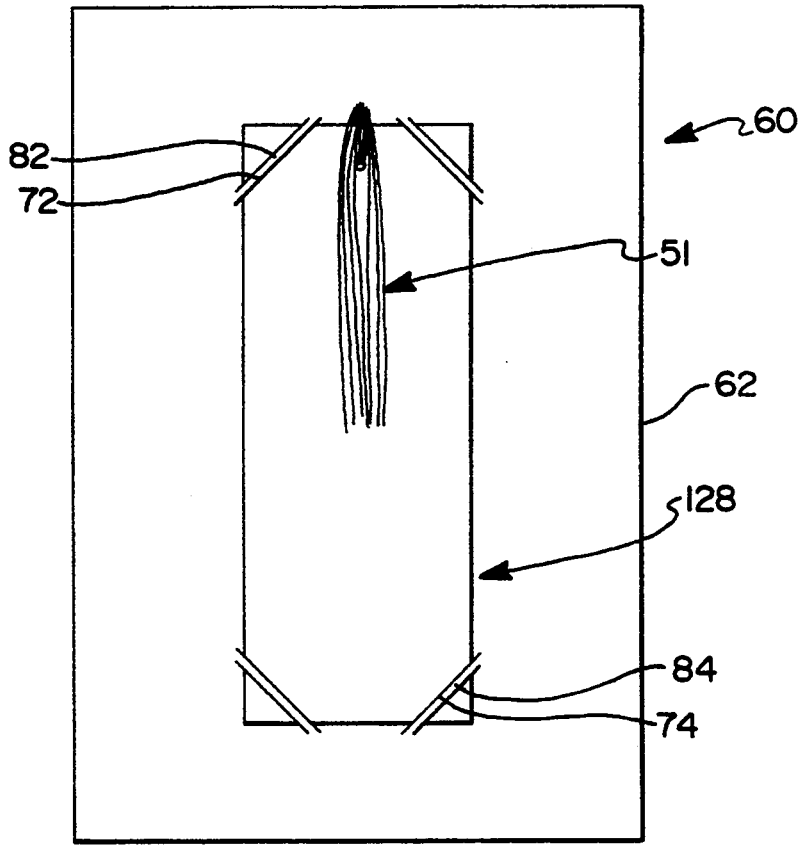
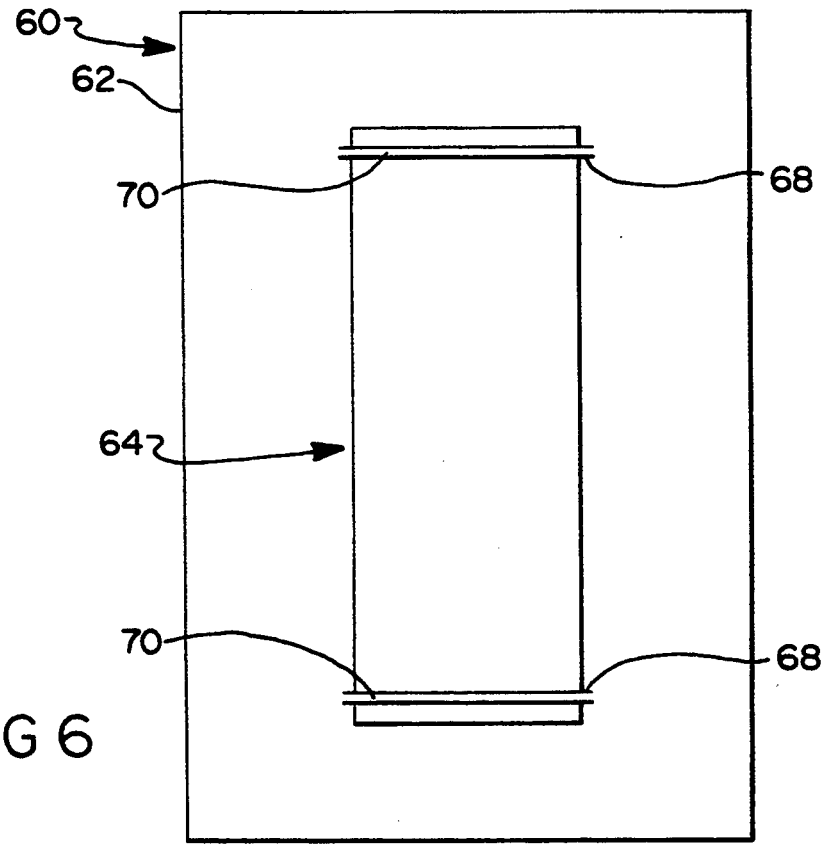
FIG 6

GREETING CARD WITH BOOKMARK

FIELD OF THE INVENTION

The present invention relates generally to construction and packaging of greeting cards, and more particularly to greeting cards including a removable decorative article.

BACKGROUND ART

There are numerous designs and constructions of greeting cards. However decorations other than imprints applied to previously known cards often substantially increase the bulk or thickness of the greeting card. As a result, the envelope for the card must be specially designed to accommodate the attachment. For example, U.S. Pat. No. 2,547,359 to Bacharach discloses a combination greeting card and frame picture which multiplies the thickness of the greeting card formed by the folded sheets to a dimension several times the combined thickness of the leaves forming the greeting card.

Similarly, U.S. Pat. No. 4,439,941 to Halperin discloses a greeting card with a removable and reusable insert in the form of an embroidered emblem. This greeting card construction requires the additional thicknesses of an adhesive bonding layer, a thermal plastic adhesive layer and the embroidered emblem in addition to the layers of sheet material forming the card. Furthermore, the sheet is specially indented by moving thickened portion rearwardly to produce a uniform surface at the face of the card. Therefore, the card requires a substantially larger envelope than would ordinarily be required for a folded sheet forming the card.

Other known greeting cards have been particularly designed to fit within the standard or conventionally-sized envelope designed for the folded sheet forming the greeting card, by forming ornamental features from the leaves forming the card. The leaves include perforated areas which can be partially or wholly punched out from the plane of the leaf. However, the perforated areas cannot be removed from the sheet without destroying the structure and ornamentation of the card. For example, U.S. Pat. Nos. 2,616,199, 3,191,328, 3,235,988 and 4,055,690 all disclose separatable portions of greeting cards, which when removed, would adversely affect the structure and ornamentation of the card.

Moreover, when ornamentation is imprinted on the greeting card, it is often discarded along with the card within a short time after the event elapses for which the greeting card was sent. The affixed message has relevance only for a relatively short time period. Thus, manufacturers of cards with previously known constructions and the packaging for cards may be more concerned with simplicity and economic considerations rather than the aesthetic value of artistic presentations on the ornamentation. While the ornamentation may be appreciated by the receiver, the limited life of the imprinted message substantially reduces the enjoyment of the ornamentation regardless of its aesthetic or artistic value to the receiver. Accordingly, the typical life of enjoyment for ornamentation applied to greeting cards is typically very short regardless of the craft or beauty employed in ornamenting the cards and it does not encourage the application of artistry on commercial greeting cards.

SUMMARY OF THE PRESENT INVENTION

The present invention overcomes the above-mentioned disadvantages by providing greeting card ornamentation in the form of a bookmark which is removable from the greeting card. In general, at least one sheet of material forms the greeting card while at least one second sheet of substantially smaller dimension forms the book mark. A connector for removably securing the bookmark to the greeting card comprises any means for fixedly positioning at least a portion of the bookmark with respect to the greeting card, but removed without destroying or removing structural or ornamental portions of the greeting card, without adding bulk or thickness to the width of the folded greeting card that would interfere with the fit of the greeting card within an envelope conventionally sized to receive the folded sheet forming the greeting card. The ornamental or decorative indicia of greeting card corresponds to the ornamental indicia on the bookmark and may be provided by the ornamental indicia on the bookmark or by a corresponding style second indicia.

In a preferred embodiment, the bookmark comprises an ornamental photographic reproduction of art work applied to a more rigid backing layer. Nevertheless, a decorative indicia may also be imprinted upon or otherwise carried by the bookmark layer. The bookmark preferably includes a perforation that receives a looped strand, more preferably comprising a plurality of filaments. Furthermore, the strand is knotted above the loop to retain the strand on the bookmark. The strand is also received through a thread wound through two perforations in a leaf of the greeting card. The strand is then pulled through the wound thread to a position where the knot retains the looped strand, and the bookmark, in a relatively fixed position with respect to the leaf.

Another preferred embodiment of the present invention employs an ornamental or decorative indicia comprising pressed flower petals retained by a sealing layer on a rigid background layer. Preferably, the petals are arranged in a pattern of overlapping flower petals. Moreover, the ornamental design preferably corresponds to an ornamental indicia with a similar design applied separately to a leaf in the greeting card.

Another embodiment employs slits in a card leaf as a connector for retaining the bookmark in a relatively fixed position with respect to the leaf of the greeting card. Preferably, the slits are provided in pairs, each slit receiving a portion of the card. In addition, a pair of slits can be used to form a strap retaining the bookmark in position on the slit leaf.

It is an advantage of the present invention to provide a greeting card with a removable ornamentation that does not substantially affect the thickness or packaging fit of the greeting card in an envelope conventionally sized to receive the greeting card. It is also an advantage of the present invention to preserve the beauty of ornamentation applied to the greeting card by providing a bookmark that can be removed from the greeting card without destroying the structure and ornamentation of the greeting card. It is also an advantage of the present invention to provide a greeting card construction and a greeting card package that includes a simple envelope without subjecting the envelope to protrusions or other discontinuities which adversely affect the integrity of the envelope during handling. It is also an advantage of the present invention to provide unique ornamentation to a greeting card which may be preserved well beyond the normal life cycle of a typical greeting card. A further advantage is to provide ornamental packaging for a greeting card with removable bookmark exhibiting the ornamentation displayed by the greeting card.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which:

FIG. 1 is a perspective view of a greeting card with bookmark combination constructed in accordance with the present invention;

FIG. 2 is an sectional view taken substantially along the line 2—2 in FIG. 1;

FIG. 3 is a elevational view of a greeting card with bookmark combination but showing a modification of the construction;

FIG. 4 is an enlarged view of the inset 4 shown in FIG. 3;

FIG. 5 is a fragmented, perspective view of the bookmark structure shown in FIG. 3;

FIG. 6 is an elevational view of another greeting card bookmark combination with modification of the structure of FIG. 7.

FIG. 7 is a front elevational view of another modification of the greeting card with bookmark combination constructed in accordance with the present invention.

DETAILED DESCRIPTION OF THE PREFERRED EMBODIMENT

Referring first to FIG. 1, greeting card 10 is shown comprising two folded sheets 12 and 14 forming leaves 16, 18, 20, and 22 respectively. Of course, the method by which each or the leaf of a greeting card 10 is made and the number of leaves to be included is variable as desired. However, each folded sheet preferably provides at least two leaves to form a conventional style of greeting card. For example, it is to be understood that folding a single sheet perpendicularly with respect to the back or spine 24 before folding the sheet along the spine 24 would also provide four leaves from substantially a single sheet. In addition, separate leaves may also be installed as desired to a folded sheet greeting card.

As shown in FIG. 1, the leaf 20 carries an ornamention indicia 26 which can be imprinted upon, adhered to or otherwise applied to the leaf. For example, a decorative thin foil layer 27 is shown adhered to the leaf, and may be margined from the edges of the leaf to form a decorative border within the confines of the leaf 20. In addition, the leaf 20 supports a bookmark 28 comprising a photographic reproduction 30 secured to a rigid support layer 32. A connector 34 for removably securing the bookmark 28 in a relatively fixed position with respect to the leaf 20 will be described in greater detail below. Nevertheless, it will be understood that any of the leaves used in forming the greeting card 10 can be selected for attachment to the bookmark 28 without departing from the scope of the present invention.

As shown in FIGS. 3 and 5, a bookmark 128 is mounted in place of the bookmark 28 shown in FIG. 1. The bookmark 128 comprises a rigid backing 32 upon which flower petals 36 can be pressed. Preferably, a plurality of flower petals 36, having a variety of shapes and sizes, are arranged in an overlapping pattern. The pattern is then sealed by a sealing layer 37 which can encase the entire bookmark so as to preserve and protect the ornamental design applied to the bookmark.

As also shown in FIG. 3, the leaf 20 has been cut out to expose the bookmark 128 within a border spaced apart from the peripheral edges of the bookmark 128. The connector 34 may be used to secure the bookmark 128 to the leaf 16, whereby the ornamental indicia 35 is exposed through an opening 46. Alternatively, the connector 34 may couple the bookmark 128 to the leaf 20, whereby a backing sheet or layer 48 is preferably secured to the rear side of leaf 20 as an ornamental backing for the bookmark 128.

Referring now to FIG. 4, a preferred embodiment of the connector 34 includes a loop of thread wound through two perforations 42 and 44 in the leaf 20. A loop 40 may be formed by one or more windings of a thread as shown in the drawing, or by otherwise securing the ends to the card. For example, the loop 40 may extend outwardly from the front face of the leaf 20 while the ends of the loop 40 not shown are secured to the rear face of the leaf, for example, by adhesive tape.

In addition, the bookmark 128 includes a strand 50 in the form of a tassel 51 formed by a plurality of filaments. The strand 50 is looped through a perforation 52 in the bookmark 128. After the tassel 51 is looped through the perforation 52, it is knotted as shown at 54 to secure it to the bookmark 128. While the ornamental appearance of the tassel is consistent with previously known ornamental bookmark tassels, the knotted tassel cooperates with the loop 40 to form a removable connector which does not destroy the ornamental design or the structure of the card when the bookmark 28 or 128 is removed from the leaf 20 of folded sheets 12 and 14 forming the card. In particular, the filaments of the tassel 51 can be inserted through the loop 40 and pulled through until the knot 54 passes through the loop 40 from the position shown in FIG. 4 to be retained above the loop 40 of FIG. 4. The multi-filament strand 50 can be compressed and therefore does not add a substantial bulk or thickness to the connector 34 which would interfere with the greeting cards fit within an envelope conventionally sized to receive the greeting card.

As is evident from FIG. 2, the construction of the bookmarks 28 or 128 and the connector 34 do not add any appreciable thickness to the card 10 which would interfere with its insertion in an envelope conventionally sized for receiving the greeting card. In particular, as discussed above, the connector is easily pressed flat so as to prevent protrusion from the envelope. Likewise, the combined thickness of the connector and the bookmark are only a fraction of the thickness of the entire card and a fraction of the thickness of the folded sheets 12 and 14 forming the card 10. Thus, a greeting card with bookmark combination 11 of the present invention is easily incorporated in a conventionally sized envelope for receiving a greeting card 10.

Referring now to FIG. 6, a greeting card with bookmark combination 60 is thereshown formed of at least one sheet 62 carrying an ornamentation 64. Preferably, as shown in FIG. 6, the ornamentation 64 is a bookmark that includes ornamental indicia 35, preferably of flower petals 36 as previously discussed. The sheet 62 includes at least one pair of slits 68 in the leaf 66 formed by the sheet. The slits 68 are sized to receive the ends of bookmark 64 so that the leaf 66 carries the bookmark 64. Preferably, as shown in FIG. 6, each slit 68 comprises a pair of spaced slits forming a strap 70, to increase exposure of the card ends while providing a removable connection of the bookmark to the greeting card. As shown in FIG. 7, a plurality of straps can also be formed to receive only a portion of the bookmark at predetermined positions. As in FIG. 11, a single slit may be provided at each location, for example, a pair of diametrically opposed slits as shown at 72 and 74. Alternatively, each slit 72 and 74 may be formed by a pair of slits forming a strap 82 and a strap 84, respectively, at diametrically opposed positions. Preferably, four such straps connect the bookmark in position on the leaf 66 although the invention is not so limited. The tassel 51 may also be provided for ornamentation only without substantially increasing the thickness of the greeting card and bookmark combination.

Having thus described the present invention many modifications thereto will become apparent to those skilled in the art to which it pertains without departing from the scope and spirit of the present invention as defined in the appended claims.

We claim:

1. A greeting card compising:

a sheet forming at least one leaf from at least one layer of sheet material;

a bookmark having at least one layer of elongated sheet material and carrying a decorative indicia;

a connecter for releasably securing the bookmark directly to said at least one leaf without substantially expanding page separation thickness of the bookmark and greeting card thickness and so that said bookmark overlies a portion of said at least one leaf; and means for displaying decorative indicia corresponding to said bookmark decorative indicia on a first of said at least one leaf.

2. The invention as defined in claim 1 wherein said means for displaying comprises another leaf of said at least one leaf that covers said first leaf and includes an opening exposing said bookmark decorative indicia through said another leaf.

3. The invention as defined in claim 1 wherein said means for displaying comprises a second decorative indicia matching said bookmark decorative indicia and fastened in a fixed position relative to said first leaf.

4. The invention as defined in claim 3 comprising another leaf including an opening and wherein said second decorative indicia is said bookmark decorative indicia exposed through said opening.

5. The invention as defined in claim 1 wherein said connector comprises a thread.

6. The invention as defined in claim 5 wherein said thread comprises a single strand wound about perforated portions of said card sheet.

7. The invention as defined in claim 1 wherein said card comprises at least one pattern of pressed flower petals.

8. The invention as defined in claim 5 wherein said pattern comprises a pattern of overlapping flower petals.

9. The invention as defined in claim 1 wherein said one leaf includes a decorative sheet having a border larger than said bookmark and fastened beneath said bookmark.

10. The invention as defined in claim 1 wherein said sheet is a folded sheet forming at least two leaves and wherein said one leaf is an interior leaf.

11. The invention as defined in claim 1 wherein said one leaf is an exterior leaf.

12. The invention as defined in claim 1 wherein said connector comprises at least one pair of slits, each slit receiving at least a portion of said bookmark.

13. The invention as defined in claim 12 wherein said connector comprises at least one pair of slits forming a strap.

14. A method for removably packaging a bookmark with a greeting card comprising:

providing a first sheet to form a greeting card having at least one leaf;

applying a decorative display to a second sheet dimensioned smaller in at least one direction than each said at least one leaf;

removably mounting said second sheet material in a fixed position directly to a first of said at least one leaf without substantially expanding page thickness of the greeting card and so that said second sheet material overlies a portion of said first of said at least one leaf; and exposing decorative indicia corresponding to said decorative display from said first of said at least one leaf.

15. The invention as defined in claim 14 wherein said removably mounting step comprises perforating said smaller sheet, and winding a thread in a loop extending through said first of said at least one leaf.

16. The invention as defined in claim 15 wherein said removably mounting step further comprises looping a flexible strand through the perforation and through the wound thread.

17. The invention as defined in claim 16 wherein said strand comprises a plurality of filaments.

18. The invention as defined in claim 16 and further comprises knotting said strand after looping said strand through the perforation.

19. The invention as defined in claim 14 wherein said applying step comprises forming a pattern by pressing at least one flower petal on said second sheet.

20. The invention as defined in claim 14 wherein said removably mounting step comprises strapping said second sheet on said first leaf.

21. The invention as defined in claim 20 wherein strapping comprises slitting at least one band from said first leaf.

22. The invention as defined in claim 21 wherein said strapping step comprises slitting at least two bands at spaced apart positions on said first leaf.

23. The invention as defined in claim 14 wherein said removably mounting step comprises slitting said first leaf, and inserting at least a portion of said second sheet material in said slit.

* * * * *

UNITED STATES PATENT AND TRADEMARK OFFICE

CERTIFICATE OF CORRECTION

PATENT NO. : 5,359,793

DATED : November 1, 1994

INVENTOR(S) : Janice A. Copperstone

It is certified that error appears in the above-indentified patent and that said Letters Patent is hereby corrected as shown below:

Abstract, line 10, "may-be" should be --may be--.
Column 1, line 66, "cards" should be -- cards, --.
Column 4, line 44, "cards" should be -- card's --.
Column 5, line 7, "11" should be --7--.

Signed and Sealed this

Twenty-fifth Day of April, 1995

*Attest:*

Bruce Lehman

BRUCE LEHMAN

*Attesting Officer*

*Commissioner of Patents and Trademarks*